US008087730B2

(12) United States Patent
Leng

(10) Patent No.: US 8,087,730 B2
(45) Date of Patent: Jan. 3, 2012

(54) COMBINED BACKREST FOR A CHAIR

(75) Inventor: Luhao Leng, Fujian (CN)

(73) Assignee: New-Tec Integration (Xiamen) Co., Ltd., Xiamen, Fujian (CN)

( * ) Notice: Subject to any disclaimer, the term of this patent is extended or adjusted under 35 U.S.C. 154(b) by 622 days.

(21) Appl. No.: 11/913,645

(22) PCT Filed: Jun. 15, 2005

(86) PCT No.: PCT/CN2005/000850

§ 371 (c)(1),
(2), (4) Date: Jun. 7, 2010

(87) PCT Pub. No.: WO2005/122835

PCT Pub. Date: Dec. 29, 2005

(65) Prior Publication Data

US 2010/0237678 A1 Sep. 23, 2010

(30) Foreign Application Priority Data

Jun. 15, 2004 (CN) ..... 2004 2 0051706 U

(51) Int. Cl.
*A47C 7/02* (2006.01)

(52) U.S. Cl. ..... 297/452.1; 297/463.1; 297/450.1; 297/440.16; 297/440.2; 297/440.21

(58) Field of Classification Search ..... 297/463.1, 297/450.1, 452.1, 440.16, 440.15, 440.2, 297/440.21
See application file for complete search history.

(56) References Cited

U.S. PATENT DOCUMENTS

| | | | | | |
|---|---|---|---|---|---|
| 1,767,099 | A | * | 6/1930 | Stevens | 297/463.1 |
| 2,538,634 | A | * | 1/1951 | Vogelsang | 248/345.1 |
| 2,630,857 | A | * | 3/1953 | Cohen | 297/452.2 |
| 2,955,646 | A | * | 10/1960 | Briggs | 297/440.21 |
| 3,704,912 | A | * | 12/1972 | Bezark | 297/447.4 |
| 4,280,269 | A | * | 7/1981 | Marini | 29/525.04 |
| 4,850,647 | A | * | 7/1989 | Engel | 297/446.1 |
| 5,018,789 | A | * | 5/1991 | Sheckells | 297/440.2 |
| 5,069,506 | A | * | 12/1991 | Wieland | 297/440.15 |
| 5,729,948 | A | * | 3/1998 | Levy et al. | 52/656.9 |
| 5,961,184 | A | * | 10/1999 | Balderi et al. | 297/448.1 |
| 6,863,348 | B1 | * | 3/2005 | Cvek | 297/440.2 |
| 6,929,275 | B1 | * | 8/2005 | Schlangen | 280/250.1 |
| 7,429,084 | B2 | * | 9/2008 | Diedrich | 297/440.16 |

FOREIGN PATENT DOCUMENTS

| | | | |
|---|---|---|---|
| JP | 11-146819 | * | 6/1992 |
| JP | 06007228 A | * | 1/1994 |

* cited by examiner

*Primary Examiner* — Laurie Cranmer
(74) *Attorney, Agent, or Firm* — Kening Li; Pinsent Masons LLP

(57) ABSTRACT

A combined backrest for a chair comprises a left side plastic fastener, a right side plastic fastener and at least one wooden rest board. The left side plastic fastener is fixedly connected to the left side rest staff. The right side plastic fastener is fixedly connected to the right side rest staff, and the left edge part and the right edge pad of the wooden rest board are fixedly connected to the left side plastic fastener and the right side plastic fastener, respectively.

8 Claims, 7 Drawing Sheets

COMBINED BACKREST FOR A CHAIR

FIELD OF INVENTION

The present invention relates to a backrest for a chair, particularly to a combined backrest for a folding chair.

BACKGROUND OF THE INVENTION

Backrests of known chairs commonly have three kinds: 1. a metal backrest made of metal; 2. a plastic backrest made of plastic; 3. a wood backrest made by wood. The metal backrest has the disadvantages of high heat conductivity and bad decoration, which makes the metal backrest not favorable for users. The plastic backrest has the disadvantages of low heat conductivity and bad decoration, which makes the plastic backrest not favorable for users. Wood backrests have moderate heat conductivity and good decoration, which makes the wood backrest favorable for users. The wood backrest has disadvantages as follows: 1. The wood backrest has an inconvenient connection with metal backrest pole and has low connection intensity; 2. The wood backrest requires a connection part for connecting with the backrest pole, which will waste much wood.

SUMMARY OF THE INVENTION

The purpose of the present invention is to overcome the disadvantages of the known technologies, to provide a combined backrest for a chair, which can save a great deal of wood and can be connected to a backrest pole easily.

The present invention adopts technical schemes as follows: a combined backrest for a chair, comprising at least one wooden rest board; the left edge part and the right edge part of the wooden rest board are fixedly connected to the left plastic fastener and the right plastic fastener respectively; the left plastic fastener has connecting piece fixedly connecting to the left rest staff and the right plastic fastener has connecting piece fixedly connecting to the right rest staff.

Said left plastic fastener is cuboid on the whole; the right side of the left plastic fastener extends rightwards to form a left flange; the left flange forms left sidestep gap with the main body of the left plastic fastener; said right plastic fastener is cuboid on the whole; the left side of the right plastic fastener extends leftwards to form a right flange; the right flange forms right sidestep gap with the right plastic fastener; the height of the left sidestep gap and the right sidestep gap is equal to the thickness of the wooden rest board; the left edge part and the right edge part of the wooden rest board fixedly lean against the left sidestep gap and the right sidestep gap respectively.

Said left plastic fastener is cuboid on the whole; the right side of the left plastic fastener caves entad to form at least a left orientation groove; said right plastic fastener is cuboid on the whole; the left side of the right plastic fastener caves entad to form at least a right orientation groove; the left edge part of the wooden rest board fixedly inserts into the left orientation groove; the right edge part of the wooden rest board fixedly inserts into the right orientation groove.

The section of said left orientation groove cooperates with the section of the left edge part of the wooden rest part; the section of the said right orientation groove cooperates with the section of the right edge part of the wooden rest board.

The left edge part and the right edge part of the wooden rest board fixedly lean against the front side of the left plastic fastener and the front side of the right plastic fastener respectively.

The front side of said left plastic fastener is plane or arc cooperating with the left edge part of wooden rest board; the front side of said right plastic fastener is plane or arc cooperating with the right edge part of the wooden rest board.

The left side of the left plastic fastener has left fixed groove cooperating with the left rest staff, to form connecting piece for connecting with the left rest staff fixedly; the right side of said right plastic fastener has right fixed groove cooperating with the right rest staff, to form connecting for connecting with the right rest staff fixedly; the fixed groove has orientation block for rest staff.

The left side of said left plastic fastener has left fixed hole cooperating with the left rest staff, to form connecting piece for connecting with the left rest staff fixedly; the right side of said right plastic fastener has right fixed hole cooperating with the right rest staff, to form connecting piece for connecting with the right rest staff fixedly.

Said wooden rest boards have two parallel pieces up and down; the right side of the left plastic fastener extends rightwards to form two left flanges up and down, there is arc gap between two left flanges; the left side of the right plastic fastener extends leftwards to form two right flanges up and down, there is arc gap between two right flanges; two edges of the upper wooden rest board are fixed on the upper left flange and the upper right flange; two edges of the nether wooden rest board are fixed on the nether left flange and the nether right flange.

Said wooden rest boards have two parallel pieces up and down; the right side of the left plastic fastener has two left orientation grooves up and down, there is a transition arc between two left orientation grooves; the left side of the right plastic fastener has two right orientation grooves up and down, there is a transition arc between two right orientation grooves; two edges of the upper wooden rest board fixedly insert into the upper left orientation groove and the upper right orientation groove respectively.

According to the above descriptions of the present invention, compared with known technologies, the present invention has virtues as follows:

First, the combined backrest of the present invention has virtues of the plastic backrest and wood backrest. The plastic backrest has virtues as follows: it has a low manufacturing cost; it is convenient to connect the plastic backrest with the rest staff and has high connection intensity; the plastic backrest is machininged expediently. The wood backrest has virtues as follows: the wood backrest has the virtues of mild temperature and mezzo heat conduction, so the user can feel kindly; the wood backrest has a good decoration.

Second, the left plastic fastener and the right plastic fastener of the combined backrest of the present invention are machininged expediently and are manufactured easily and has a low manufacturing lost; it is convenient to connect the plastic fasteners with the rest staff and has a high connection intensity. The wooden rest board has the virtues of the wooden backrest; the wooden rest board is easily connected with the left plastic fastener and the right plastic fastener.

Third, the left side edge and the right side edge of every wooden rest board fixedly lean against the left gap and the right gap respectively, which has a high connection intensity; the front side of the left plastic fastener and the front side of the right plastic fastener are aligned, which has humanization and to make users feel well.

Forth, the left edge part and the right edge part of the wooden rest board of the present invention fixedly insert into the left orientation groove and the right orientation groove, which is connected easily and has a high connection intensity. The section of the left orientation groove matches with the section of the section of the left side edge of the wooden rest board; the section of the right orientation groove matches with the section of the right side edge of the wooden rest board; which is connected fixedly.

Fifth, the left edge part and the right edge part of every wooden rest board fixedly lean against the front side of the left plastic fastener and the front side of the right plastic fastener respectively; the left plastic fastener matches with the left edge part of every wooden rest board and the right plastic fastener matched with the right edge part of every wooden rest board, which is machininged easily and has a high connection intensity.

Sixth, the left plastic fastener of the present invention fixedly connects with the left rest staff by the left fixed groove buckling into the left rest staff and by screw or rivet; the right plastic fastener fixedly connects with the right rest staff by the right fixed groove buckling into the right rest staff and by screw or rivet. The left plastic fastener of the present invention fixedly connects with the left rest staff by the left fixed hole sheathing the left rest staff and by screw and rivet; the right plastic fastener of the present invention fixedly connects with the right rest staff by the right fixed hole sheathing the right rest staff and by screw and rivet.

Seventh, the left plastic fastener and the right plastic fastener of the present invention can be replaced by left metal fastener and the right metal fastener as required.

DETAILED DESCRIPTION OF THE PREFERRED EMBODIMENTS

Referring to the attached drawings, we will explain the present invention farther.

Embodiment 1

Figure 1:
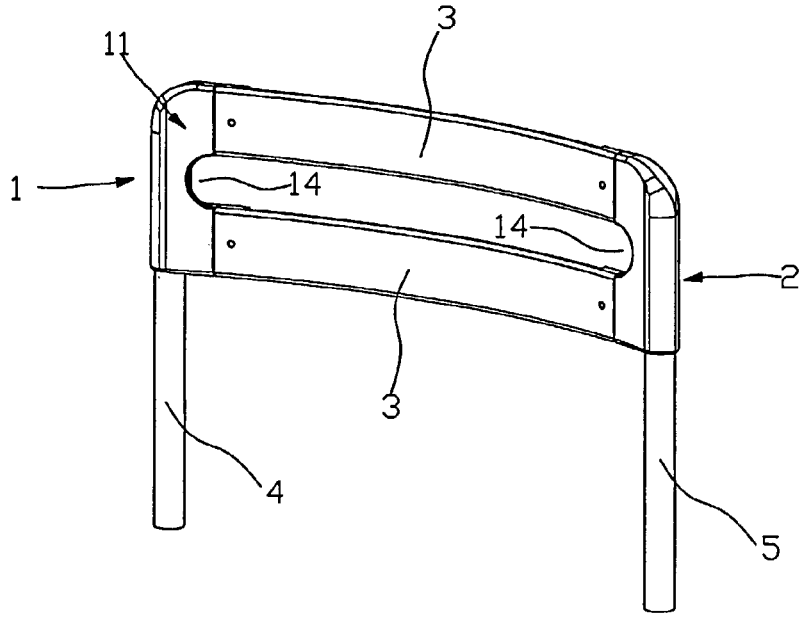
FIG. 1 is a three-dimensional sketch map of the embodiment 1 of the present invention.
Figure 2:
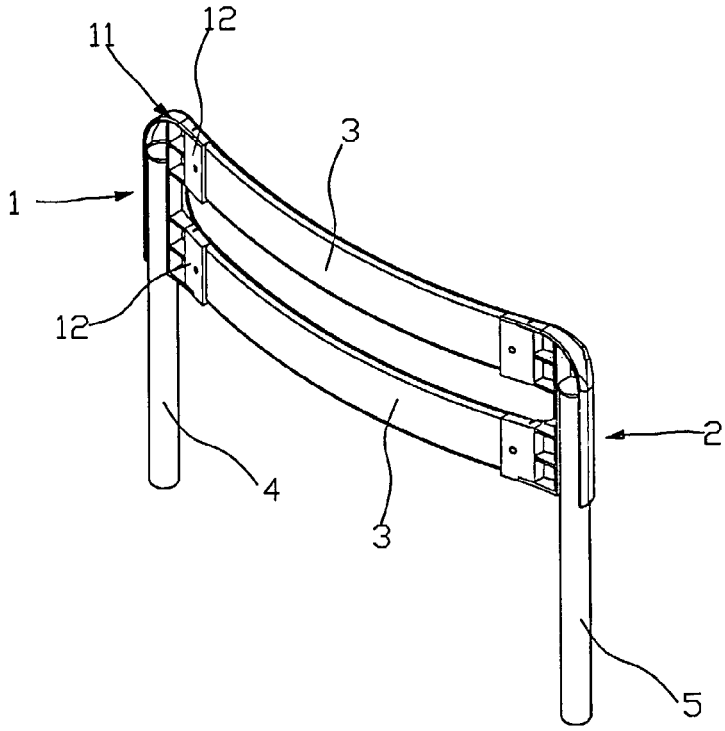
FIG. 2 is another three-dimensional sketch map of the embodiment 1 of the present invention.
Figure 3:
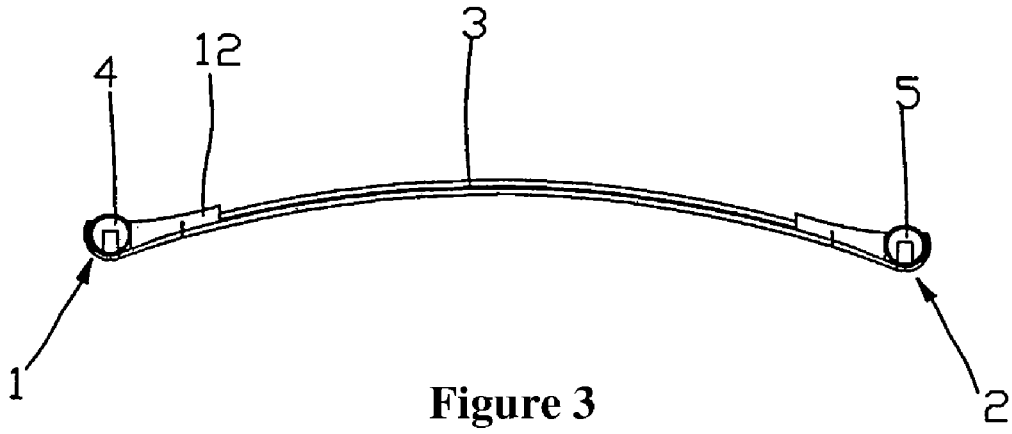
FIG. 3 is the bottom view of the embodiment 1 of the present invention.

A combined backrest for a chair, as shown in FIGS. 1 to 3, comprises left plastic fastener 1, right plastic fastener 2 and two wooden rest boards 3. The left plastic fastener 1 and the right plastic fastener 2 are symmetrical. The left plastic fastener 1 is fixedly connected to left rest staff 4 and the right plastic fastener 2 is fixedly connected to the right rest staff 5. The left edge part and the right edge part of two wooden rest boards 3 are fixedly connected to the left plastic fastener 1 and the right plastic fastener 2 respectively.

Figure 4:
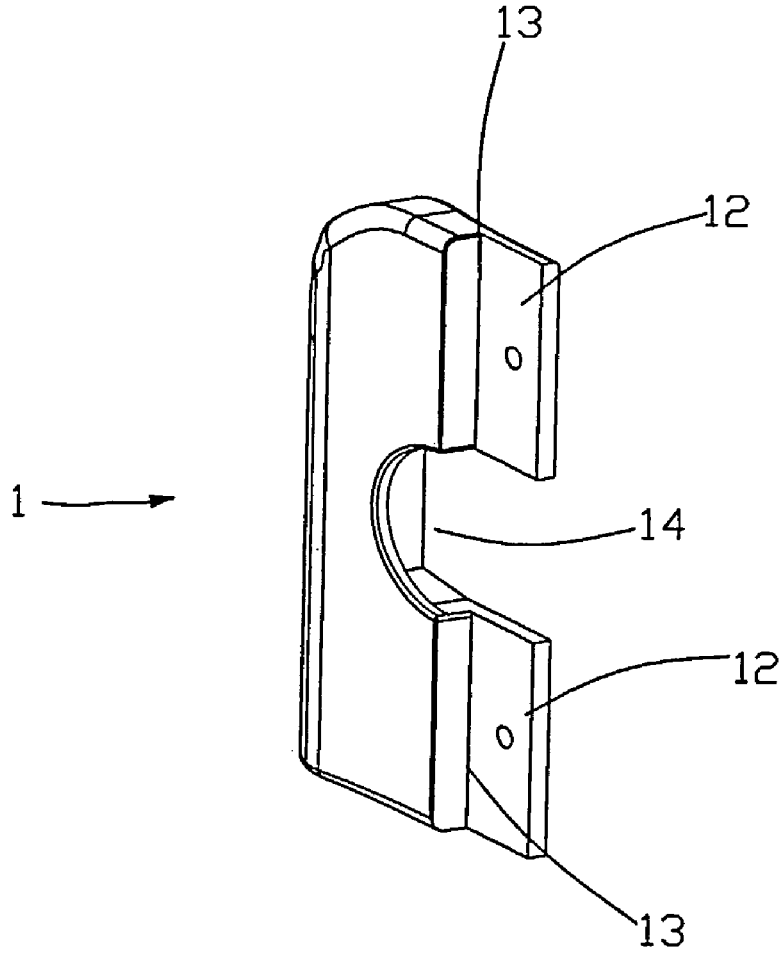
FIG. 4 is a three-dimensional sketch map of the left plastic fastener of the embodiment 1 of the present invention.
Figure 5:
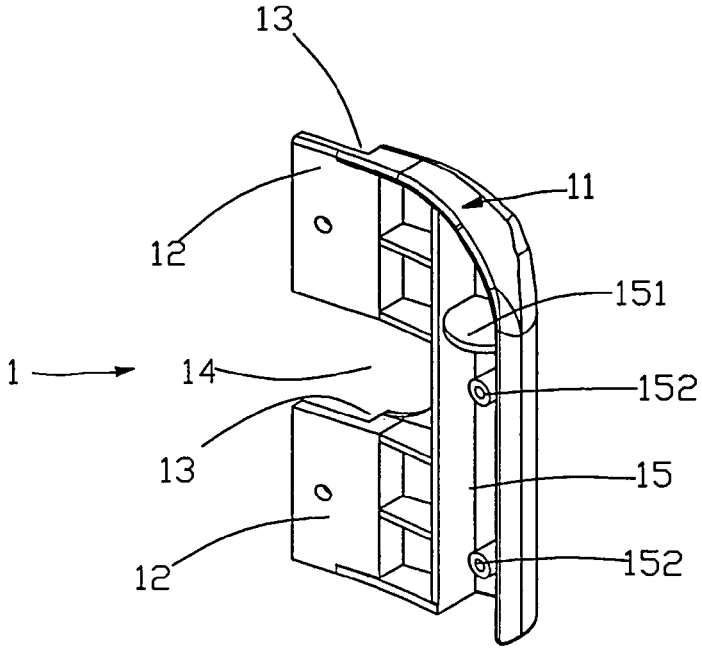
FIG. 5 is another three-dimensional sketch map of the left plastic fastener of the embodiment 1 of the present invention.
Figure 6:
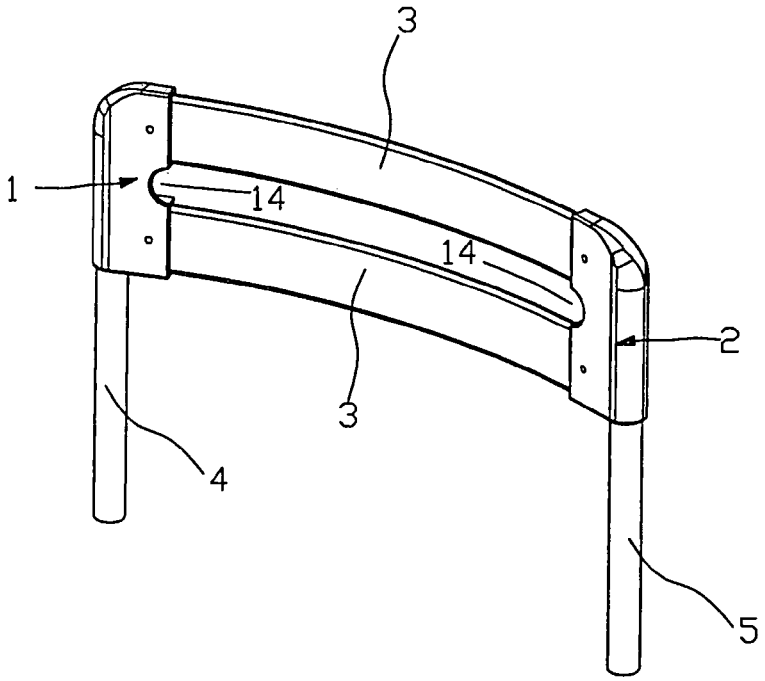
FIG. 6 is a three-dimensional sketch map of the embodiment 2 of the present invention.

As shown in FIGS. 4 and 5, the left plastic fastener 1 is cuboid on the whole; the right side of the left plastic fastener 1 extends rightwards to form two left flanges 12 on the upside edge part and the downside edge part; two left flanges 12 form two sidestep gaps 13 with the main body 11 of the left plastic fastener respectively. Two left flanges 12 are equally set on the upside edge part and the downside edge part of the right side of the main body 11 of the left plastic fastener. The middle part of right side of the main body 11 of the left plastic fastener has a decorative gap 14. The sections of left edge parts of two wooden rest boards 3 cooperate with two sidestep gaps 13.

As shown in FIGS. 2 and 3 and 5, the back side of left section of the main body 11 of the left plastic fastener has a left fixed groove 15 cooperating with the left rest staff 5. The left fixed groove 15 has a left orientation block 151 for orientation of the left rest staff 5 and two screw orientation holes 152 for the passage of screws. The left fixed groove 15 is fixedly connected to the left rest staff 4 by buckling mode and by two screws drilling through the screw orientation holes 152 of the left fixed groove 15 and the left rest staff 4.

As shown in FIGS. 1 to 3, the right plastic fastener 2 has the same structure with the left plastic fastener 1, and the left plastic fastener 1 and the right plastic fastener are symmetrical. The right plastic fastener 2 also has two sidestep gaps. The section of the right edge parts of two wooden rest boards 3 cooperates with two sidestep gaps.

As shown in FIGS. 1 to 3, the left edge parts of two wooden rest boards 3 fixedly lean against two left sidestep gaps 13 and are locked by screws; the right edge parts of two wooden rest boards 3 fixedly lean against two right sidestep gaps 13 and are locked by screws. The front side of the left plastic fastener 1 and the front side of the right plastic fastener 2 and the front sides of two wooden rest boards 3 are aligned.

Embodiment 2

The present embodiment has difference with embodiment 1: as shown in FIGS. 6 to 9, the right side of the left plastic fastener 1 caves entad to form two left orientation grooves 16; there is a transition arc 14 between two left orientation grooves 16; the section of left orientation grooves 16 cooperates with the section of the left edge part of the wooden rest boards 3.

Figure 7:
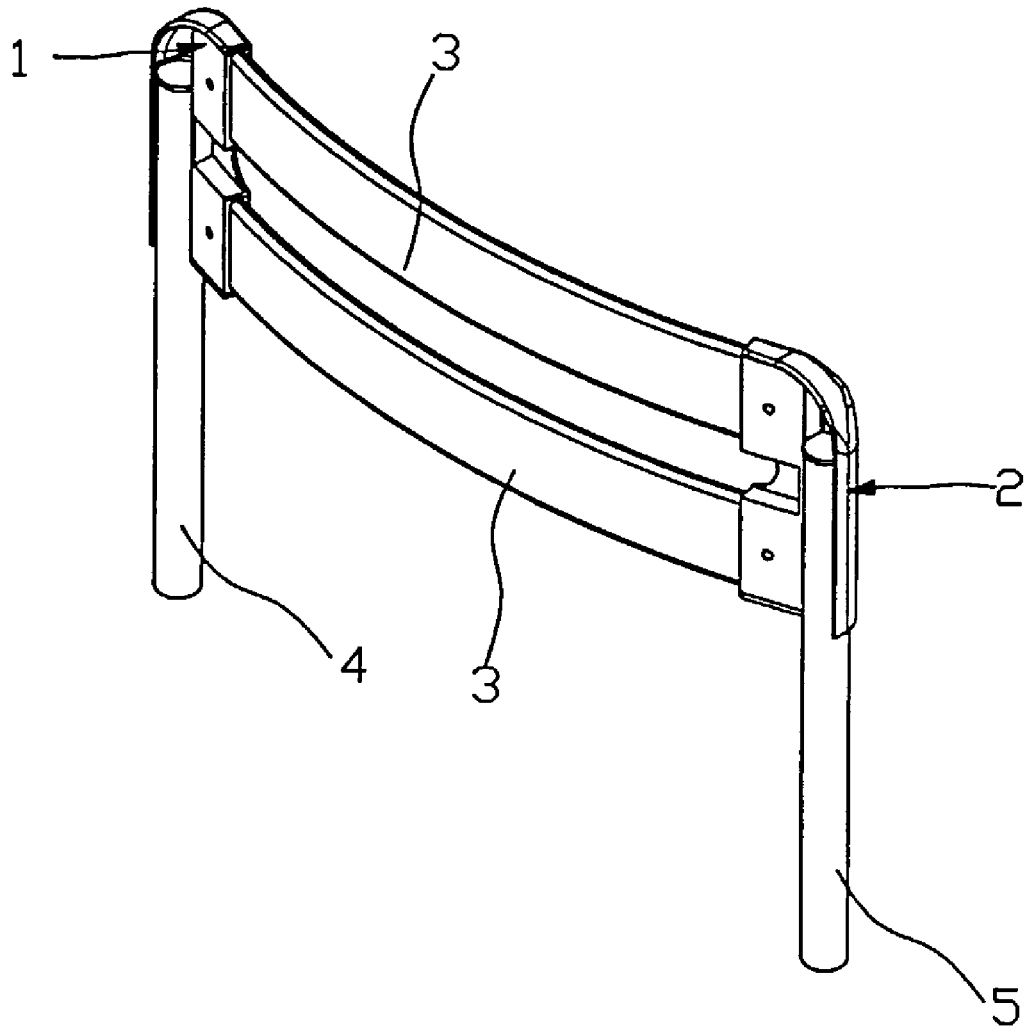
FIG. 7 is another three-dimensional sketch map of the embodiment 2 of the present invention.
Figure 8:
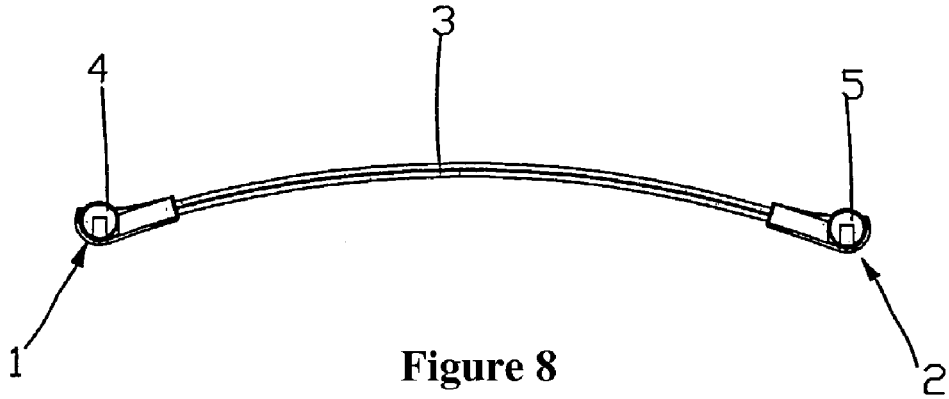
FIG. 8 is the bottom view of the embodiment 2 of the present invention.
Figure 9:
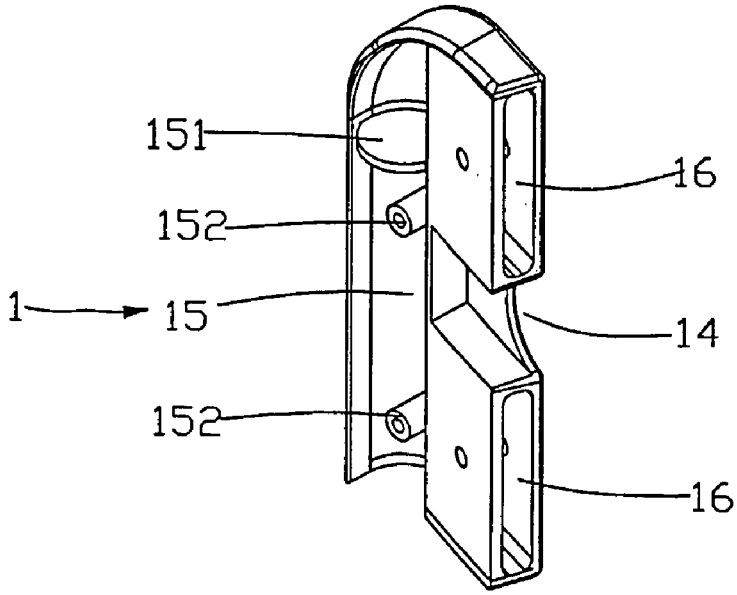
FIG. 9 is a three-dimensional sketch map of the left plastic fastener of the embodiment 2 of the present invention.

As shown in FIGS. 7 to 9, the back side of left section of the main body 11 of the left plastic fastener has a left fixed groove 15 cooperating with the left rest staff 5. The left fixed groove 15 has a left orientation block 151 for orientation of the left rest staff 5 and two screw orientation holes 152 for the passage of screws. The left fixed groove 15 is fixedly connected to the left rest staff 4 by buckling mode and by two screws drilling through the screw orientation holes 152 of the left fixed groove 15 and the left rest staff 4.

The right plastic fastener 2 has the same structure with the left plastic fastener 1, and the left plastic fastener 1 and the right plastic fastener 2 are symmetrical. The left side of the right plastic fastener 1 caves entad to form two right orientation grooves; the section of the right orientation grooves cooperates with the section of the right edge parts of the wooden rest boards 3.

The left edge parts of two wooden rest boards 3 insert into two left orientation grooves 16 respectively and are locked by screws; the right edge parts of two wooden rest boards 3 insert into two right orientation grooves respectively and are locked by screws.

Embodiment 3

Figure 10:
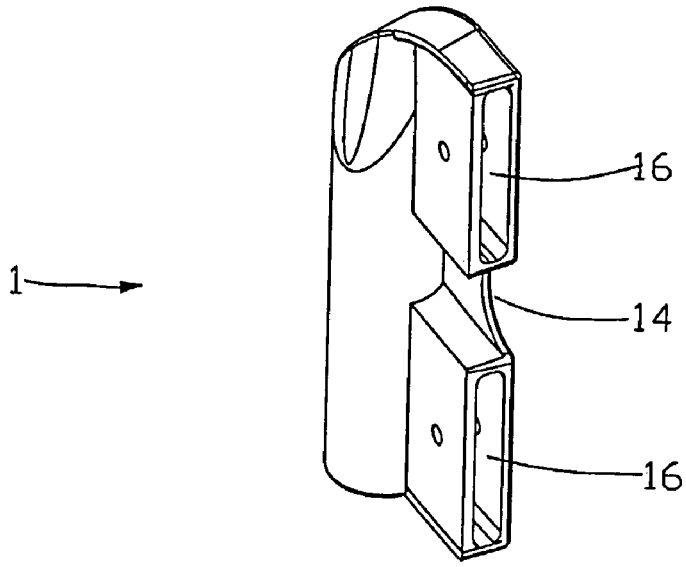
FIG. 10 is a three-dimensional sketch map of the left plastic fastener of the embodiment 3 of the present invention.

The present embodiment has difference with the embodiment 2: as shown in FIG. 10, the undersurface of the left section of the left plastic fastener 1 has left fixed hole cooperating with the left rest staff 4; the left fixed hole sheaths the left rest staff 4 and are locked by screw. The right plastic fastener 2 has the same structure with the left plastic fastener 1, and the left plastic fastener 1 and the right plastic fastener 2 are symmetrical; the right section of the right plastic fastener 2 has right fixed hole cooperating with right rest staff 5; the right fixed hole sheaths the right rest staff 5 and are locked by screws.

Embodiment 4

Figure 11:
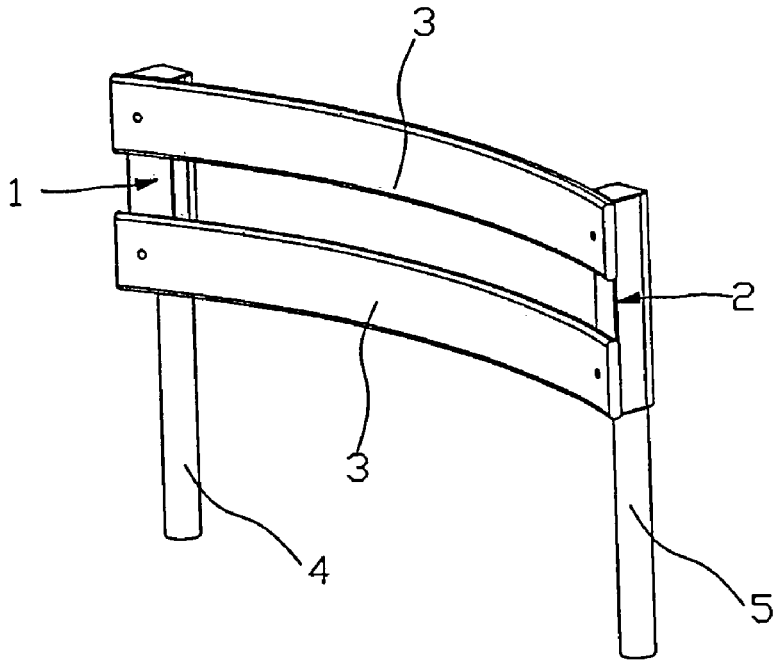
FIG. 11 is the three-dimensional sketch map of the embodiment 4 of the present invention.
Figure 12:
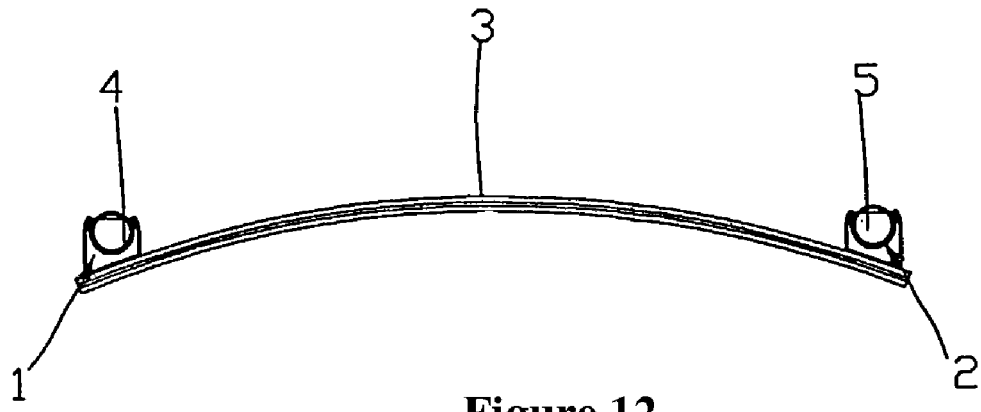
FIG. 12 is the bottom view of the embodiment 4 of the present invention.
Figure 13:
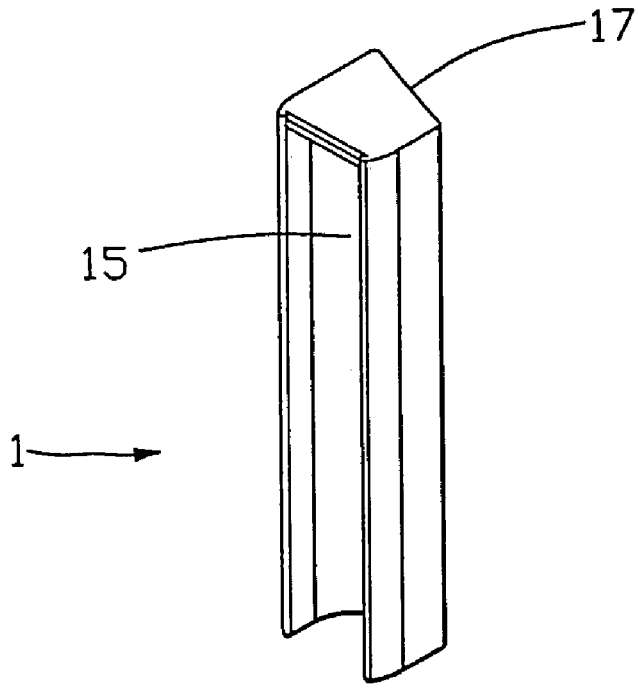
FIG. 13 is a three-dimensional sketch map of the left plastic fastener of the embodiment 4 of the present invention.

The present invention has difference with embodiment 1: as shown in FIGS. 11 to 13, the front side 17 of the left plastic fastener 1 is machininged to cooperate with the back side of the left edge parts of the wooden rest boards 3, such as plane or arc; the front side of the right plastic fastener 2 is machininged to cooperate with the back side of the right edge parts of the wooden rest boards, such as plane or arc.

The left edge parts of two wooden rest boards 3 fixedly lean against the front side 17 of the left plastic fastener 1. The back side of the left plastic fastener 1 has left fixed groove 15 cooperating with the left rest staff 4. The left fixed groove 15 is connected to the left rest staff 4 by buckling mode. The left plastic fastener 1 and the left rest staff 4 and the left edge parts of the wooden rest boards 3 are locked by two screws.

The right edge parts of two wooden rest boards 3 fixedly lean against the front side of the right plastic fastener 2. The back side of the right plastic fastener 2 has right fixed groove cooperating with the right rest staff 5. The right fixed groove 15 is connected to the right rest staff 5 by buckling mode. The right plastic fastener 2 and the right rest staff 5 and the right edge parts of the wooden rest boards 3 are locked by two screws.

The right plastic fastener 2 has the same structure with the left plastic fastener 1, and the left plastic fastener 1 and the right plastic fastener 2 are symmetrical.

While the present invention has been described in connection with what is considered the most practical and preferred embodiments, it is understood that present invention is not limited to the disclosed embodiments but is intended to cover various arrangements included within the spirit and scope of the broadest interpretation so as to encompass all such modifications and equivalent arrangements.

INDUSTRIAL PRACTICABILITY

The combined backrest for a chair of the present invention makes wooden rest boards and plastic fasteners as a combined backrest; wooden rest boards and plastic fasteners can be industrialized, and are easily machininged as many shapes to maintain different demands; the present invention has a good industry practicability.

I claim:

1. A backrest for a chair, comprising a wood rest board having a left edge and a right edge, the left edge and the right edge being fixedly connected to a left plastic fastener and a right plastic fastener respectively, wherein the left plastic fastener has a connecting piece fixedly connected to a left rest staff and the right plastic fastener has connecting piece fixedly connected to a right rest staff, wherein the wood rest board comprises an upper piece and a lower piece positioned parallel to each other; the right side of the left plastic fastener extends rightwards to form two left flanges, an arc-shaped gap positioned between the two left flanges; the left side of the right plastic fastener extends leftwards to form two right flanges, an arc-shaped gap positioned between the two right flanges; wherein two edges of the upper piece are fixed on the upper left flange and the upper right flange; and two edges of the lower piece are fixed on the lower left flange and the lower right flange.

2. The backrest according to claim 1, wherein the left edges and the right edges of the wood rest board are respectively fixedly connected to a front side of the left plastic fastener and a front side of the right plastic fastener.

3. The backrest according to claim 1, wherein a front side of the left and right plastic fastener is flat or arched, to match respectively the left and right edge of the wood rest board.

4. The backrest according to claim 1, wherein the left side of the left plastic fastener has a left fixed groove cooperating with the left rest staff, to form a connecting piece for connecting with the left rest staff fixedly; wherein the right side of said right plastic fastener has a right fixed groove cooperating with the right rest staff, to form a connecting piece for connecting with the right rest staff fixedly; and wherein each of the fixed grooves has an orientation block for the rest staff.

5. The backrest according to claim 1, wherein the left side of said left plastic fastener has left fixed hole cooperating with the left rest staff, to form a connecting piece for connecting with the left rest staff fixedly; and the right side of said right plastic fastener has right fixed hole cooperating with the right rest staff, to form a connecting piece for connecting with the right rest staff fixedly.

6. A backrest for a chair, comprising a wood rest board which comprises an upper piece and a lower piece positioned parallel to each other, each of the upper and lower piece having a left edge and a right edge, the left edge and the right edge being fixedly connected to a left plastic fastener and a right plastic fastener respectively, wherein the left plastic fastener has a connecting piece fixedly connected to a left rest staff and the right plastic fastener has connecting piece fixedly connected to a right rest staff, wherein the left plastic fastener has an overall cuboid configuration having a main body, a right side of the left plastic fastener extending rightwards to form an upper left flange and a lower left flange, respectively corresponding to the left edge of the upper piece and the left edge of the lower piece, with an arc-shaped gap positioned between two left flanges; the upper left flange and the lower left flange each, together with the main body forms an upper left sidestep gap and a lower left sidestep, respectively;

wherein the right plastic fastener has an overall cuboid configuration having a main body, a left side of the right plastic fastener extending leftwards to form an upper right flange and a lower right flange, respectively corresponding to the right edge of the upper piece and the right edge of the lower piece, with an arc-shaped gap positioned between two right flanges; the upper right flange and the lower right flange each, together with the main body, forms an upper right sidestep gap and a lower right sidestep gap, respectively, wherein the height of all the sidestep gaps is equal to the thickness of the wood rest board, wherein the left edge part and the right edge part of the upper piece and the lower piece are fixedly connected respectively to the corresponding sidestep gaps.

7. A backrest for a chair, comprising a wood rest board having a left edge and a right edge, the left edge and the right edge being fixedly connected to a left plastic fastener and a right plastic fastener respectively, wherein the left plastic fastener has a connecting piece fixedly connected to a left rest staff and the right plastic fastener has connecting piece fixedly connected to a right rest staff, wherein the wood rest board comprises an upper piece and a lower piece positioned parallel to each other, the right side of the left plastic fastener has two left orientation grooves and a transition arc between the two left orientation grooves; the left side of the right plastic fastener has two right orientation grooves, and a transition arc between the two right orientation grooves; where the two edges of the upper piece are fixedly inserted into the upper left orientation groove and the upper right orientation groove respectively.

8. The backrest according to claim 7, wherein the left orientation groove and the left edge of the wood rest part coincides in cross-section; and the right orientation groove and the right edge of the wood rest board coincides in cross-section.

* * * * *